US009951492B2

(12) United States Patent
Habdank

(10) Patent No.: US 9,951,492 B2
(45) Date of Patent: Apr. 24, 2018

(54) METHOD AND DEVICE FOR MONITORING THE RAMMING OF A RAM POST INTO THE GROUND

(71) Applicant: Habdank PV-Montagesysteme GmbH & Co. KG, Göppingen (DE)

(72) Inventor: Martin Habdank, Heiningen (DE)

(73) Assignee: Habdank PV-Montagesysteme GmbH & Co. KG, Göppingen (DE)

( * ) Notice: Subject to any disclaimer, the term of this patent is extended or adjusted under 35 U.S.C. 154(b) by 0 days.

(21) Appl. No.: 15/303,224

(22) PCT Filed: Apr. 14, 2014

(86) PCT No.: PCT/EP2014/057470
§ 371 (c)(1),
(2) Date: Oct. 11, 2016

(87) PCT Pub. No.: WO2015/158358
PCT Pub. Date: Oct. 22, 2015

(65) Prior Publication Data

US 2017/0030042 A1 Feb. 2, 2017

(51) Int. Cl.

| | |
|---|---|
| ***E02D 7/06*** | (2006.01) |
| ***E02D 7/10*** | (2006.01) |
| ***E02D 13/06*** | (2006.01) |
| ***E02D 7/00*** | (2006.01) |
| ***B25D 9/26*** | (2006.01) |
| ***E04H 17/26*** | (2006.01) |

(52) U.S. Cl.
CPC ..... *E02D 7/06* (2013.01); *B25D 9/26* (2013.01); *E02D 7/00* (2013.01); *E02D 7/10* (2013.01); *E02D 13/06* (2013.01); *E04H 17/263* (2013.01); *B25D 2250/221* (2013.01)

(58) Field of Classification Search
CPC .... E02D 7/02; E02D 7/06; E02D 7/10; E02D 7/14; E02D 13/06
See application file for complete search history.

(56) References Cited

U.S. PATENT DOCUMENTS

| | | | | |
|---|---|---|---|---|
| 3,946,598 A * | 3/1976 | Towne | E02D 1/02 | 73/11.03 |
| 4,365,306 A * | 12/1982 | House | E02D 13/06 | 173/20 |
| 5,978,749 A * | 11/1999 | Likins, Jr. | E02D 13/00 | 700/108 |
| 6,301,551 B1 * | 10/2001 | Piscalko | E02D 13/06 | 340/853.8 |
| 6,349,590 B1 * | 2/2002 | Wai | E02D 33/00 | 73/84 |

(Continued)

FOREIGN PATENT DOCUMENTS

EP 2458089 5/2012

*Primary Examiner* — Frederick L Lagman
(74) *Attorney, Agent, or Firm* — Michael Soderman

(57) ABSTRACT

The invention relates to a method for monitoring the ramming of a ram post (1) into the ground. A succession of blows are struck on the ram post (1) via an impact driving device (3), causing the ram post (1) to be rammed into the ground. Parameters for the load-bearing capacity of the ram post (1) in the ground are ascertained during the ramming of the ram post (1) via a monitoring unit (14).

14 Claims, 4 Drawing Sheets

(56) References Cited

U.S. PATENT DOCUMENTS

| | | | | |
|---|---|---|---|---|
| 6,533,502 | B2 * | 3/2003 | McVay | E02D 13/06 340/853.8 |
| 8,684,632 | B2 * | 4/2014 | Grover | E02D 27/14 405/232 |
| 9,458,593 | B2 * | 10/2016 | Hale | E02D 27/16 |
| 2005/0117975 | A1 * | 6/2005 | England | E02D 27/14 405/229 |
| 2007/0074881 | A1 * | 4/2007 | Bermingham | E02D 7/02 173/2 |
| 2008/0131211 | A1 * | 6/2008 | NeSmith | E02D 5/36 405/241 |
| 2012/0070233 | A1 * | 3/2012 | Wang | E02D 27/425 405/232 |
| 2012/0203462 | A1 | 8/2012 | Dalton et al. | |
| 2014/0352449 | A1 * | 12/2014 | Hale | E02D 33/00 73/786 |
| 2014/0356075 | A1 * | 12/2014 | Hale | E02D 27/16 405/230 |

* cited by examiner

METHOD AND DEVICE FOR MONITORING THE RAMMING OF A RAM POST INTO THE GROUND

CROSS REFERENCE TO RELATED APPLICATIONS

This application is the U.S. national stage of International Application No. PCT/EP2014/057470, filed on 2014 Apr. 14.

BACKGROUND

The invention relates to a method and a device for monitoring the ramming of a ram post into the ground.

Ram posts of this type general serve as supporting elements for objects of all kinds. In general, the lower end of a ram post of this type is rammed into the ground so that the lower part of the ram post is plunged into the ground and is fixed in place there in a secured position. The upper part of the ram post projects above the surface of the ground, so objects can be attached there that are then held by the ram post.

Ram posts of this type can be used in the most diverse applications. Applications are conceivable in principle in which an individual ram post is provided that solely supports an object, for instance a poster or an advertising medium.

Ram posts are used especially often in applications in which several ram posts are required to support objects. Support structures for solar modules that are designed, in particular, in the form of open-ground installations are an example of this. A series arrangement of ram posts that are rammed into the soil is required in systems of that type. The support structure, comprised of an arrangement of individual supports that then support the solar modules, is then mounted on the exposed upper ends of the ram posts.

A problem with regard to systems of that type is generally a stable, solid anchoring of the ram posts in the ground, especially in soil. A more or less stable hold of the ram posts is obtained depending on the nature of the soil. If ram posts are anchored in loose soil, as an example, only a slight hold of the ram post is obtained. Instability of the entire support structure results from that, though.

SUMMARY

The invention relates to a method for monitoring the ramming of a ram post (1) into the ground. A succession of blows are struck on the ram post (1) via an impact driving device (3), causing the ram post (1) to be rammed into the ground. Parameters for the load-bearing capacity of the ram post (1) in the ground are ascertained during the ramming of the ram post (1) via a monitoring unit (14).

DETAILED DESCRIPTION

The invention is based on the objective of providing a device and a method that ensure increased functional reliability of ram posts that are rammed into the ground.

The features of the independent claims are provided to solve this problem. Advantageous embodiments and useful design developments of the invention are described in the dependent claims.

The invention relates to a method for monitoring the ramming of a ram post into the ground. A succession of blows are struck on the ram posts, which drive the ram post into the ground, via an impact driving device. Parameters for the load-bearing capacity of the ram post in the ground are ascertained during the ramming of the ram post via a monitoring unit.

The invention further relates to a corresponding method.

The basic idea of the invention is to consequently determine the load-bearing capacity of the ram post in the ground during the ramming of the ram post via the impact driving device; a reliable measure of how securely the ram post is anchored in the ground will already be available at, or immediately after, the end of the ramming process because of that.

The term impact driving device also includes, in particular, devices with vibration drive units that generate blows with low energy but higher frequencies than devices with impact drive units that carry out hammer-like blows.

As a measure of the load-bearing capacity, information is generally recorded with the monitoring unit as to the difficulty, meaning the resistance, with which the ram post is rammed into the ground. The more difficult it is for the ram post to be rammed, meaning the greater the effort required to ram the ram post into the ground, the greater the load-bearing capacity of the ram post, meaning the greater the stability of the ram post in the ground.

The parameters obtained via the monitoring unit for the load-bearing capacity of the ram post are immediately available after the ramming process and can be immediately utilized by the user, especially to the effect that the ram post will not be stressed with loads that are too large, which would impair the stability of the ram post.

Since the resistance that is required to ram the ram post is generally ascertained to determine the load-bearing capacity of a ram post, supplemental information can be obtained in the process, for instance with regard to obstacles such as stones that make the ramming of the ram post more difficult or prevent it.

As a special advantage, the results of the monitoring unit can be used in the case that several ram posts are required to create large installations. Support structures for solar modules that are designed, in particular, in the form of open-ground installations are an example of installations of this type. A number of posts have to be rammed into the ground there; supports are then fastened to these posts that hold the solar modules. A determination can be made in the case of installations of that type with the aid of parameters that are obtained with the monitoring unit as to how stable the mounting of the individual posts is in the ground. In dependence upon that, the user can immediately choose a suitable post arrangement on-site that ensures adequate stability of the support structure. When the user establishes that a ram post has a high load-bearing capacity, he can then space the subsequent ram posts relatively far apart. In contrast, when a ram post has a low load-bearing capacity, he can then put the next ram post close to it to obtain the required stability of the overall system.

In accordance with a first variant of the invention, the number of blows that are required to ram the ram post into a specified target depth in the ground is determined as a parameter for the load-bearing capacity.

The total number of blows required to ram in the ram post constitutes an integral quantity as a measure for the load-bearing capacity of the ram post.

These parameters for the individual ram posts are advantageously compared to a reference quantity. This reference quantity advantageously defines a value for a sufficient load-bearing capacity of the ram post. The number of blows that are currently required is then compared during the ramming of a ram post with the reference quantity that is likewise made up of a number. If the number of blows that is currently obtained is greater than the reference quantity, the load-bearing capacity of the ram post is sufficient. If the number of blows that is currently obtained is smaller than the reference quantity, the load-bearing capacity of the ram post is insufficient.

In accordance with a second variant of the invention, the distance to which the ram post is rammed into the ground with a pre-determined number of blows is determined as a parameter for the load-bearing capacity.

This parameter is advantageously obtained several times during the ramming of the ram post, so spatially resolved information regarding the load-bearing capacity of the ram post is obtained over the ramming path of the ram posts.

These parameters are then advantageously compared to reference quantities that, like the parameters, are location-dependent.

In the two above-mentioned variants, the force that is exerted on the ram post when it is rammed is advantageously kept constant, so a measurement of the forces acting on the ram post that are exerted by the impact driving device is not required. Instead, only the number of blows that are struck on the ram post with the impact driving device and the distance traveled by the ram post while being rammed into the ground are recorded as measured quantities.

The monitoring unit of the device as per the invention has suitable measurement equipment for this; the measured values of the measurement equipment are read into the computer unit of the monitoring unit and evaluated there.

In accordance with a third variant of the invention, the force exerted on the ram post during the individual blows and the penetration depth of the ram post into the ground brought about by the respective blows are ascertained as parameters for the load-bearing capacity.

In this case, the forces that are exerted on the ram post with the impact driving device do not have to be kept constant, because they are directly recorded as measured quantities; the monitoring unit preferably has a force sensor for this whose measured values, along with the measured values for the path measurement, are read into the computer unit of the monitoring unit and evaluated there.

A spatially resolved profile of the load-bearing capacity that is compared to the corresponding reference quantities is also obtained in this variant in dependence upon the path of the ram post when it is being rammed into the ground.

In general, the monitoring unit has an output unit for outputting the parameters.

A user can comfortably monitor the ramming process of the ram post with the aid of parameters that are output in this way.

In accordance with an advantageous embodiment, the device as per the invention and the impact driving device have an impact drive unit that can be moved with a linear drive unit, which drives an impact piece that strikes the top of the ram post.

A controlled feed of the impact drive unit is ensured with the linear drive unit, so the impact drive unit continuously stays guided on the ram post when it is being rammed in so that a succession of blows are struck with the impact pieces on the ram post.

The impact piece advantageously has a receptacle for the upper edge of the ram post here, so the impact piece is always guided by the upper edge of the ram post.

BRIEF DESCRIPTION OF THE DRAWINGS

The invention will be explained with the aid of the drawings below.

a) in a longitudinal representation b) in a side wall

Figure 4A:
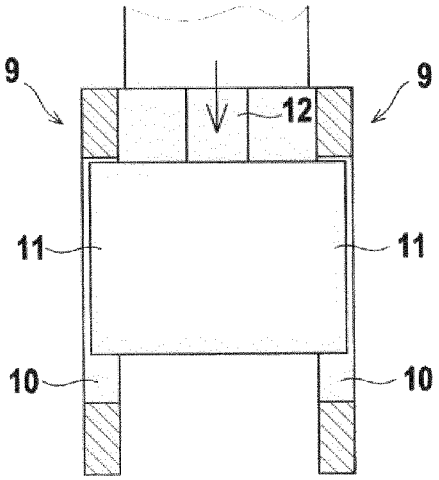
FIG. 4: Partial representation of the impact driving device with a guide for an impact piece.
Figure 4B:
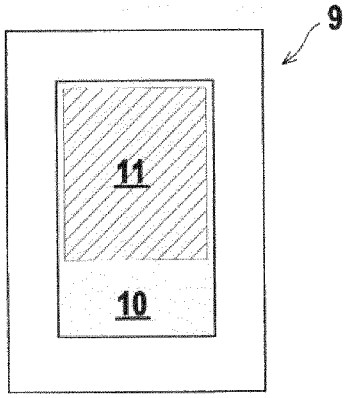
Figure 5:
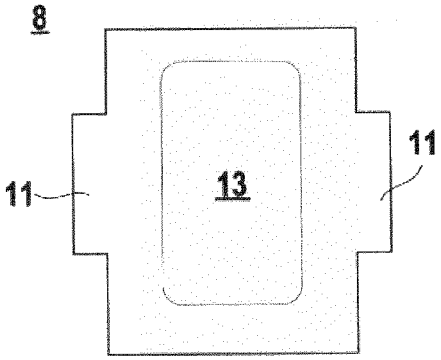

FIG. 5: Plan view of the bottom of the impact piece in accordance with FIG. 4.

Figure 6:
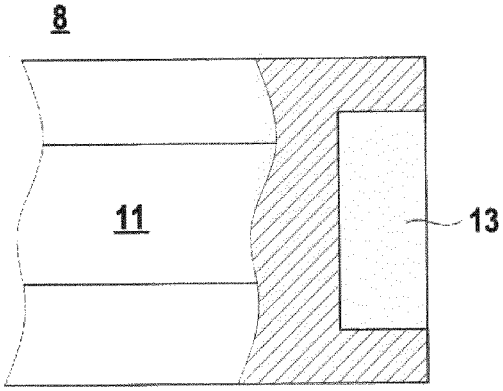

FIG. 6: Partially cutaway side view of the impact piece in accordance with FIG. 4.

Figure 7:
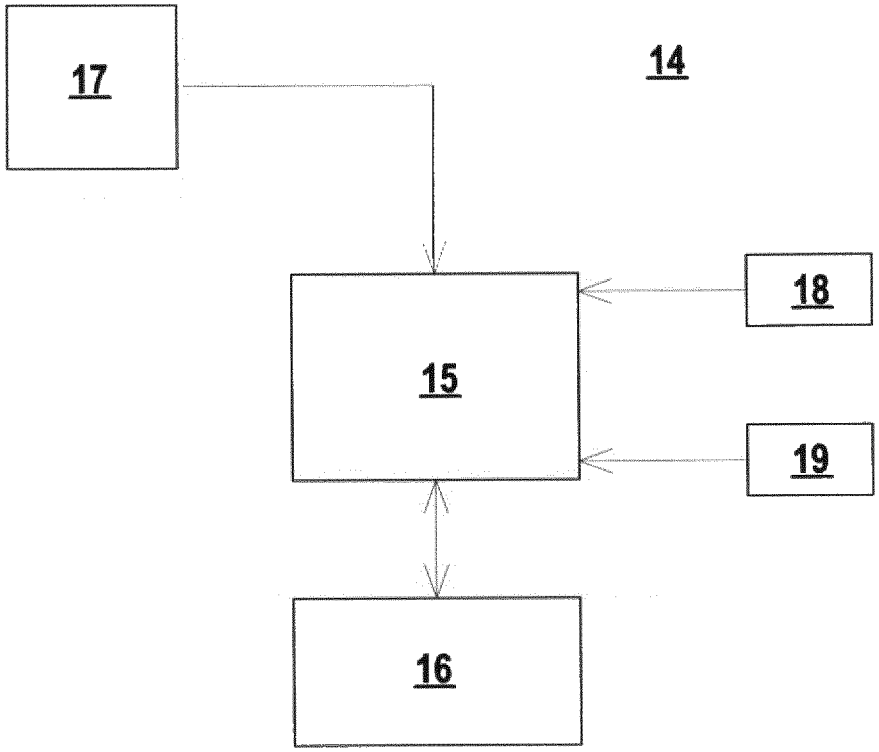

FIG. 7: Block diagram of a monitoring unit assigned to the impact driving device in accordance with FIG. 3.

DETAILED DESCRIPTION OF THE PREFERRED EMBODIMENTS

Figure 1:
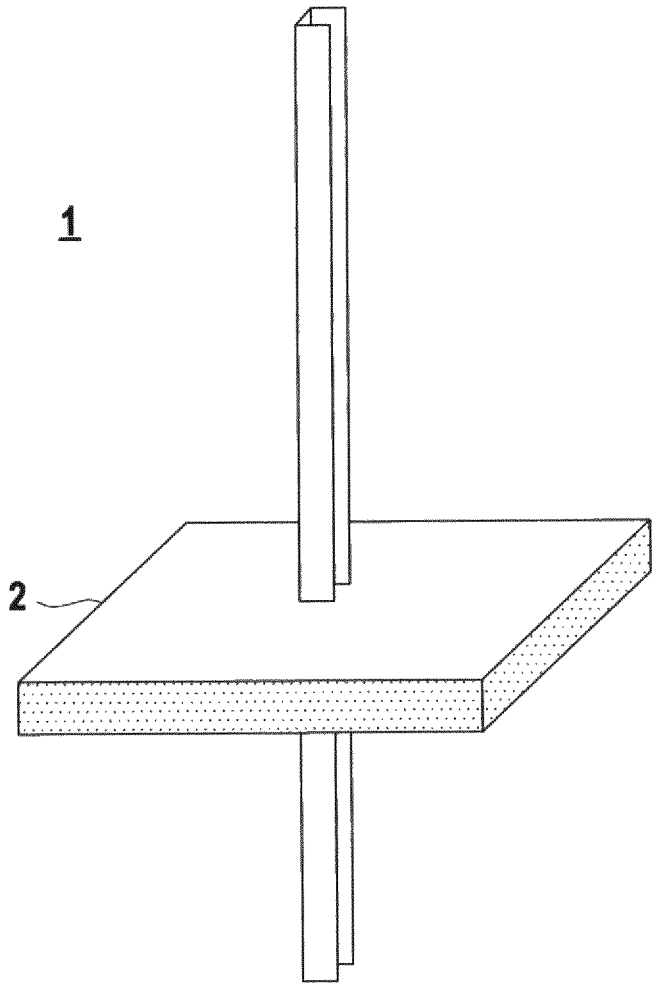
FIG. 1: Schematic diagram of a ram post rammed into the ground.

FIG. 1 shows an example of a ram post 1 that is rammed into the ground, especially into the soil 2. FIG. 1 only shows a small section of the soil 2 around the ram post 1 in the area of the surface of the earth for the sake of simplicity. In general, the ram post 1 is rammed into a target position in the soil 2 in which a section of the ram post 1 is in the soil 2 and the remaining section B of the ram post 1 projects above the surface of the earth.

Figure 2:
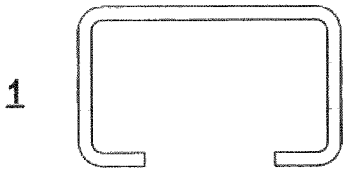
FIG. 2: Cross-sectional diagram of a ram post in accordance with FIG. 1.

The ram post 1 is comprised in this case of a rectangular C profile (FIG. 2) that is made of a metallic material, especially steel. The cross-section of the C profile is constant over its entire length. The lower edges of the C profile have a small cross-sectional area with which the ram post 1 can be easily introduced into the soil 2. The C profile can also have a different, polygonal cross-section.

Figure 3:
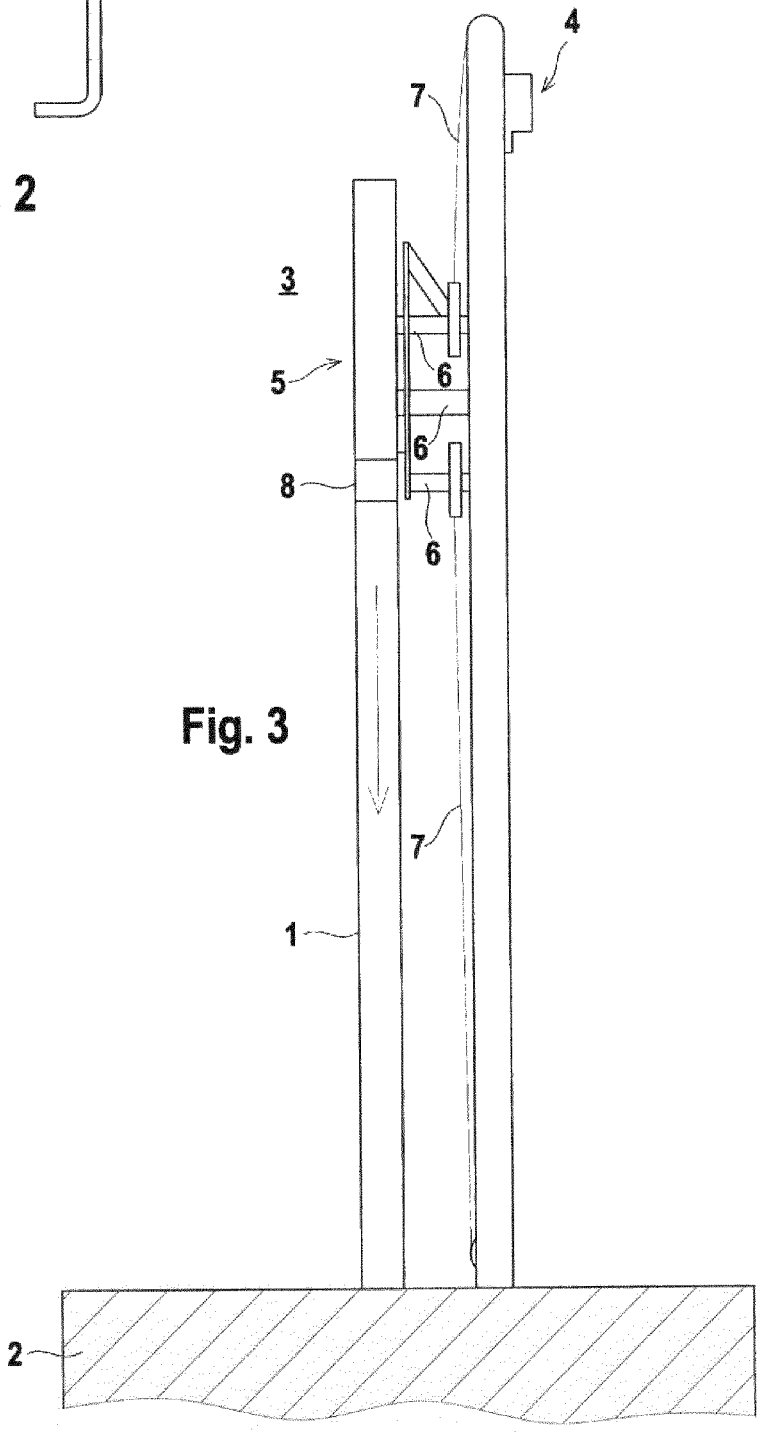
FIG. 3: Schematic diagram of an impact driving device for ramming a ram post.

FIG. 3 shows an example of an impact driving device 3 via which a ram post 1 is rammed into the ground. The impact driving device 3 is comprised of a linear drive unit 4 in the form of a mast on which an impact drive unit 5 is supported so as to be capable of movement in a vertical direction. The impact drive unit 5 is supported with holding fixtures 6 in a longitudinal guide of the linear drive unit 4. In addition, the holding fixture 6 of the impact drive unit 5 is held on the linear drive unit 4 with steel cables 7, which are actuated by the linear drive unit 4 to move the impact drive unit 5 in a vertical direction.

The impact drive unit 5 has a hydraulic drive unit in this case that actuates an impact piece 8 so that the impact piece 8 strikes a succession of blows on the top of the ram post 1 and thereby rams the ram post 1 into the ground. The impact piece 8 is mounted on the upper edge of the ram post 1 here.

FIGS. 4*a*, 4*b* show the impact piece 8, which is mounted in a guide so as to be capable of movement in the longitudinal direction. The guide is comprised of two plate-shaped guide elements 9 with an identical design that each have a rectangular recess 10. Guide segments 11, as components of the impact piece 8, are guided in them, so the impact piece 8 can only carry out a guided vertical movement. The impact piece 8 strikes blows on the ram post 1 in the direction of the arrow shown in FIG. 4*a* via a tappet 12 acting on the top of the impact piece 8; the ram post 1 is rammed into the ground because of that.

FIGS. 5 and 6 show the impact piece 8 in an individual diagram. The impact piece 8 essentially has a rectangular shape. A hollow area 13 forming a pocket is provided on the bottom of the impact piece 8 into which the upper edge of the ram post 1 is inserted. The contour of the hollow area 13 is adapted to the cross-section of the ram post 1 so that its upper edge is mounted in the hollow area 13 with little play.

The guide segments 11 project on opposite side walls of the impact drive unit 5. The guide segments 11, which project from the flat side walls and which have an identical design, extend over the entire height of the impact drive unit 5 and have a constant rectangular cross-section.

A monitoring unit 14 schematically shown in FIG. 7 is assigned to the impact driving device 3; the device for monitoring the ramming of the ram post 1 as per the invention is formed because of that. The monitoring unit 14 is comprised of a computer unit 15 and an input/output unit 16, for instance in the form of a terminal, that is assigned to it.

The control unit 17 of the impact drive unit 5 is connected to the computer unit 15 so that the number of blows that are struck by the impact drive unit 5 on the ram post 1 is recorded and can be evaluated in the computer unit 15.

Furthermore, distance-measuring devices 18 for determining the distance traveled by the ram post 1 during the ramming are connected to the computer unit 15. A cable sensor can be provided on the linear drive unit 4, for example, as the distance-measuring device 18. In principle, a sensor that records distance-measuring markings on the linear drive unit 4 can also be arranged as a distance-measuring device 18 on the impact drive unit 5 in the area of the impact piece 8 The measured values of the distance-measuring device 18 are also read into the computer unit 15 and evaluated there.

As an option, a force sensor 19, via which the forces exerted by the impact piece 8 on the ram post 1 are directly measured, can also be provided in the area of the impact piece 8. These measured values are also evaluated in the computer unit 15.

Parameters for the load-bearing capacity of the ram post in the ground are obtained during the ramming of the ram post 1 via the monitoring unit 14 that is formed in that way, and they are even output during the ramming or immediately after the ramming of the ram post 1 via the input/output unit 16.

In accordance with a first, simple variant, the blows on the ram post 1 that are required to ram the ram post 1 into a target depth in the ground are counted in the computer unit 15 through the control unit 17 of the impact drive unit 5; the target depth is monitored with the distance-measuring devices 18. In this case, it is ensured via design measures that the forces exerted by the impact piece 8 on the ram post 1 are consent. The force sensor 19 can therefore be dispensed of.

The number of blows that are required provides a relative measurement of the load-bearing capacity of the ram post 1 in the ground, because the load-bearing capacity, meaning the hold of the ram post 1 in the ground, is greater when the number of blows that are required is higher.

The number of blows that is obtained is advantageously compared to a reference value that is obtained for a ram post 1 with a load-bearing capacity that is still adequate. A sufficient load-bearing capacity is then reported via the input/output unit 16 when the number of blows is greater than the reference value. Otherwise, insufficient load-bearing capacity is generated as an output value.

In general, the above-mentioned method can be extended to a spatially resolved determination of the load-bearing capacity. In this case, the ramming path that the ram post 1 travels through with a pre-determined number of blows is successively obtained during the ramming of the ram post 1.

In the case that the forces exerted on the ram post 1 by the impact piece 8 are not constant, the force sensor 19 is advantageously used. In that case, the forces exerted on the ram post 1 are progressively obtained as parameters during the ramming process and the ram-in distances of the ram post 1 brought about by the forces are determined. Spatially resolved information regarding the load-bearing capacity of the ram post 1 is also obtained in this case.

LIST OF REFERENCE NUMERALS (1) Ram post
(2) Soil
(3) Impact driving device
(4) Linear drive unit
(5) Impact drive unit
(6) Holding fixture
(7) Steel cable
(8) Impact piece
(9) Guide element
(10) Recess
(11) Guide segment
(12) Tappet
(13) Hollow area
(14) Monitoring unit
(15) Computer unit
(16) Input/output unit
(17) Control unit
(18) Distance-measuring device
(19) Force sensor

The invention claimed is:

1. A method for assembling a support structure for solar modules, said support structure comprising a number of ram posts that are rammed into the ground, wherein the ramming of each ram post into the ground is monitored, comprising the steps: striking the ram post with a succession of blows via an impact driving device, causing the ram post to be rammed into the ground, obtaining parameters for the load-bearing capacity of the ram post in the ground during the ramming of the ram post via a monitoring unit and determining the spacing of successive ram posts in the support structure in dependence upon the parameters that are obtained in such a way that adequate stability of the overall support structure is ensured.

2. The method according to claim 1, wherein the number of blows that are required to ram the ram post to a pre-determined target depth in the ground is obtained as a parameter for the load-bearing capacity during monitoring of the ramming of a ram post.

3. The method according to claim 1, wherein the distance to which the ram post is rammed into the ground with a pre-determined number of blows is determined as a parameter for the load-bearing capacity during monitoring of the ramming of a ram post.

4. The method according to claim 2, wherein the force exerted during the individual blows on the ram post is constant.

5. The method according to claim 1, wherein the forces exerted on the ram post during the individual blows are obtained as parameters for the load-bearing capacity during monitoring of the ramming of a ram post and the penetration depth of the ram post into the ground brought about by the respective blows is determined.

6. The method according to claim 1, wherein the parameters that are obtained are compared to reference values.

7. A device for assembling a support structure for solar modules, said support structure made up of a number of ram posts that are rammed into the ground, wherein the ramming of each ram post into the ground is monitored by the device, comprising an impact driving device via which a succession of blows is struck on the ram post, causing the ram post to be rammed into the ground, and a monitoring unit via which parameters for the load-bearing capacity of the ram post in the ground are obtained during the ramming of the ram post, such that the spacing of successive ram posts in the support structure is determined in dependence upon the parameters that are obtained in such a way that adequate stability is ensured.

8. The device according to claim 7, wherein the impact driving device has an impact drive unit that can be moved via a linear drive unit, said impact drive unit driving an impact piece that strikes blows on the top of the ram post.

9. The device according to claim 8, wherein the impact drive unit is comprised of a hydraulic drive unit.

10. The device according to claim 8, wherein a succession of blows with a variable impact frequency and a constant force is generated with the impact drive unit.

11. The device according to claim 8, wherein the impact piece has a receptacle for an upper edge of the ram post.

12. The device according to claim 7, wherein the monitoring unit has a computer unit and measurement equipment to measure the distance traveled by the ram post, wherein the measured values of the measurement equipment are read into the computer unit.

13. The device according to claim 7, wherein the monitoring unit has measurement equipment to determine the number of blows of an impact piece and/or a force sensor to determine the forces exerted by the impact piece on the ram post, wherein their measured values are read into the computer unit.

14. The device according to claim 7, wherein the monitoring unit has an output unit for outputting the parameters.

* * * * *